US006155890A

United States Patent [19]

Gerberding

[11] Patent Number: 6,155,890

[45] Date of Patent: Dec. 5, 2000

[54] SPRING LOADED CLAMPING CONNECTION FOR ELECTRICAL CONDUCTORS

[75] Inventor: Wolfgang Gerberding, Hessisch-Oldendorf, Germany

[73] Assignee: WAGO Verwaltungsgesellschaft mbH, Minden, Germany

[21] Appl. No.: 09/293,862

[22] Filed: Apr. 16, 1999

[30] Foreign Application Priority Data

Apr. 17, 1998 [DE] Germany ..... 198 17 925

[51] Int. Cl.[7] ..... H01R 4/48

[52] U.S. Cl. ..... 439/835

[58] Field of Search ..... 439/834, 835, 439/838, 828

[56] References Cited

U.S. PATENT DOCUMENTS

| | | | |
|---|---|---|---|
| 4,647,140 | 3/1987 | Crawford | 439/834 |
| 4,708,417 | 11/1987 | Woertz | 439/835 |
| 5,575,695 | 11/1996 | De Bernardis | 439/834 |
| 5,816,867 | 10/1998 | Davidsz et al. | 439/835 |
| 5,860,837 | 1/1999 | Bock et al. | 439/834 |
| 5,879,204 | 3/1999 | Delarue et al. | 439/835 |

FOREIGN PATENT DOCUMENTS

| | | | |
|---|---|---|---|
| 0 806 811 A2 | 4/1997 | European Pat. Off. . | |
| 0806811 | 11/1997 | European Pat. Off. | 439/835 |
| 44 13 151 A1 | 4/1994 | Germany . | |

*Primary Examiner*—Paula Bradley
*Assistant Examiner*—Briggitte R. Hammond
*Attorney, Agent, or Firm*—Salter & Michaelson

[57] ABSTRACT

A spring loaded clamping connection for electrical conductors comprises a clamping spring and a current bar. The clamping spring is in the shape of a closed loop having a contact leg which lies parallel at the current bar and a clamping leg which crosses the free end of the current bar. It is proposed to provide at the end-part of the current bar two levels at different heights. In the lower level the contact leg lies on the current bar and in the upper level there is a platform of the current bar which cooperates with the clamping leg of the clamping spring to form a clamping unit.

8 Claims, 3 Drawing Sheets

SPRING LOADED CLAMPING CONNECTION FOR ELECTRICAL CONDUCTORS

The present invention relates to a spring loaded clamping connection for electrical conductors.

Clamping connections of this type were developed by the applicant in 1977 containing so-called "CAGE-CLAMP"-springs ("CAGE CLAMP" is the trademark of the applicant), and clamping connections of this type are now also marketed by other producers in large quantities.

In the most cases of use the clamping unit of the clamping connection must be opened to introduce and/or to remove an electrical conductor. This is done by manually pressing down the clamping leg of the clamping spring, which extends from the backward spring bow of the clamping spring and which is bent in the shape of a loop. The free end of the clamping leg runs in the transverse direction (for e.g. with an angle of 70 to 90° ) to the free end of the contact leg of the clamping spring or to the free end of the current bar respectively, on which the contact leg is lying. When the clamping leg is pressed down, an over-stretching (overloading) of the backward spring bow and/or of the clamping leg of the clamping spring must be prevented. For this purpose, clamping connections of this type contain an overload protection in the form of stopper elements, which are arranged in the inner space of the clamping springs and do prevent the clamping leg from being pressed down too much. Said inner space of the clamping spring is defined by the space surrounded from the contact leg and the clamping leg of the clamping spring. The EP 0 806 811 A2/Weidm üller is an example of the state of art technology.

Spring loaded clamping connections of the above type comprise a clamping unit for an electrical conductor, which is to be introduced along the underside of the current bar. Thus the structuraloverall height of such a clamping connection is low, because the conductor receiving space for the electrical conductor is just below and parallel to the current bar. Moreover, the loop of the clamping leg is close to the upper side of the current bar, and also the stopper element for the overload protection is arranged inside the clamping spring.

Nevertheless the main object of the present invention is to optimize the structure of a spring loaded clamping connection of this type in order to further minimize the overall height and space required. This object of the invention is well known and is, in fact, a long-standing demand of the electrical industry requesting always space-saving, but functional-reliable miniaturization of clamping connections of all types.

According to the present invention the above object is solved by the idea to provide at the end part of the current bar two levels at different heights. In the lower level, the contact leg of the clamping spring sits on the current bar. In the upper level, there is a platform of the current bar which cooperates with the clamping leg of the clamping spring to form the clamping unit.

The exact details of the teaching of the invention are specified by the wording of claim 1. Further embodiments of the invention are defined by the wordings of claim 2 to 5.

According to the invention, the arrangement of the platform mentioned above in the upper level of a current bar is of a great advantage. On the one hand, this upper platform acts as an excellent stopper element against unwanted overloading of the clamping spring. Accordingly, the arrangement of a special stopper element in the inner space of the clamping spring, as this had been necessary so far, can be avoided and now the inner space is kept free and can be used for other purposes.

On the other hand, the underside of the upper platform forms a part of the clamping unit for the electrical conductor. Thus the electrical conductor is now positioned directly at and parallel to the underside of the platform in the upper level, and the end of the electrical conductor is allowed to extend into the inner space of the clamping spring, because—as mentioned above—the inner space of the clamping spring is kept free of other elements.

This leads to a decrease in the structural overall height of the clamping connection because its overall height no longer depends (as that was usual in the state of art) on the necessary height for the maximum opening hub of the clamping spring plus the height of the stopper element usually arranged in the inner space of the clamping spring, but is now (according to the invention) mainly determined by the maximum opening hub of the clamping spring. This is because the opening hub of the clamping leg of the clamping spring, which is directed downwards, overlaps the height of the spacer frame, which is directed upwards to carry the upper platform acting as a stopper element for the clamping leg.

The new construction of the clamping connection is self-contained i.e. no pressure of the clamping force is transmitted to the insulating housing. With the new construction, the overload protection is integrated into the two-level-construction of the current bar. Therefore the new clamping connection according to the invention can be handled as a self-contained and very compact modular unit which can be inserted into a receiving chamber of an insulating housing through (via) a side opening of the housing as well as through (via) a front opening of the housing. Of course, the new clamping connection can be used also without any housing, if that is practicable.

Moreover the new construction has a high resistance to vibrations and can be used very well especially for machines and installations which cause exciting oscillations or which are subjected to them. This is because the mass of a clamped electrical conductor is positioned right in the center of the clamping spring, and the mass of the clamping spring itself and the mass of the current bar are divided on both sides of said center such that resonance phenomenons do not occur.

Other advantages and novel features of the invention will become more apparent from the following description making reference to the drawings. The drawings show preferred embodiments of the invention, wherein FIGS. 1 and 2 show a first embodiment of the invention;

Figure 1:
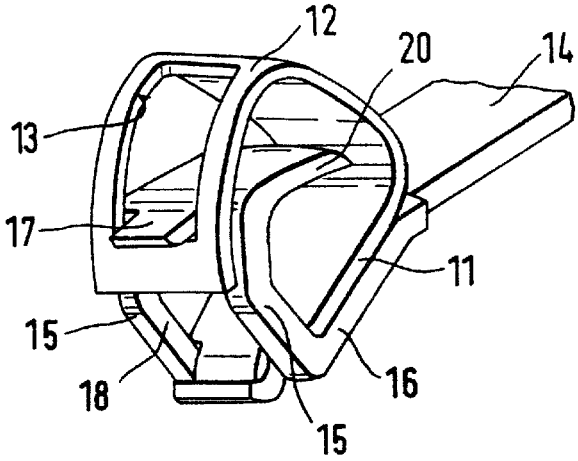
Figure 2:
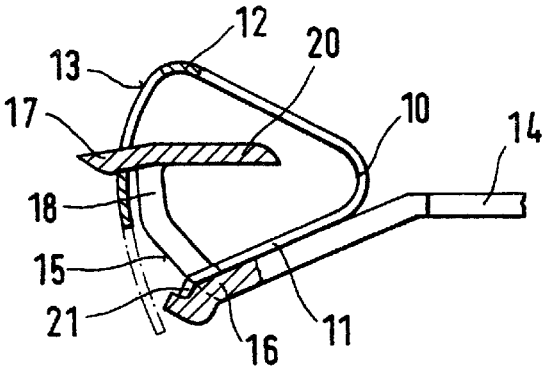
Figure 3:
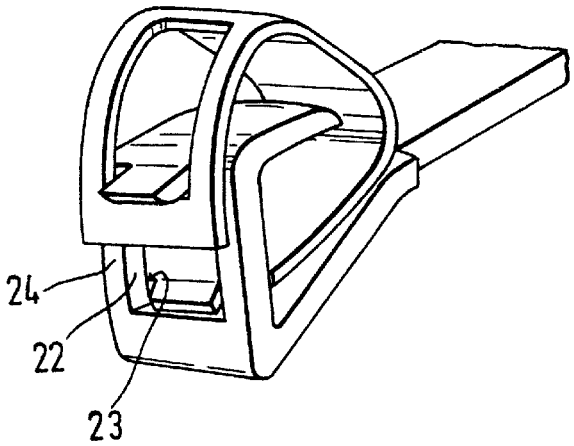
FIGS. 3 to 6 show a second embodiment with an insulating housing.

FIGS. 1 and 2 show the new spring loaded clamping connection in a perspective view and in a side-view (partly cut) with a clamping spring, which is made from spring steel sheet and which comprises a backward spring bow (10) from which extends a contact leg 11 and a clamping leg 12. In the free end of the clamping leg 12, the window opening 13 is punched out.

The current bar 14 comprises an end-part on which the clamping spring is mounted. This end-part has two levels. In the lower level the lower platform 16 is positioned, and the upper level is constituted by the upper platform 17. The spacer frame 15 has a wall opening 17. When this wall opening is being punched out two inner pieces of material are cut free from the edges of the wall opening and then both pieces of material are bent to the left to form the platforms 16 and 17. Accordingly all those parts are made out of the same material as the current bar 14 which is made from a strip of flat material having good electrical conductivity (for e.g. electrolyte copper with a tin plated surface).

Figure 4:
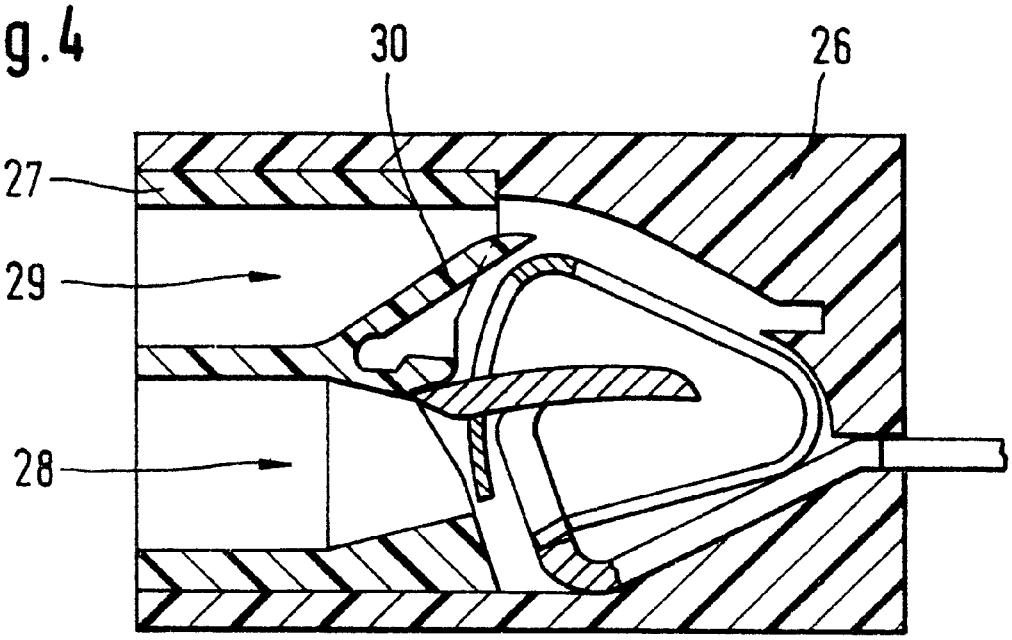
Figure 5:
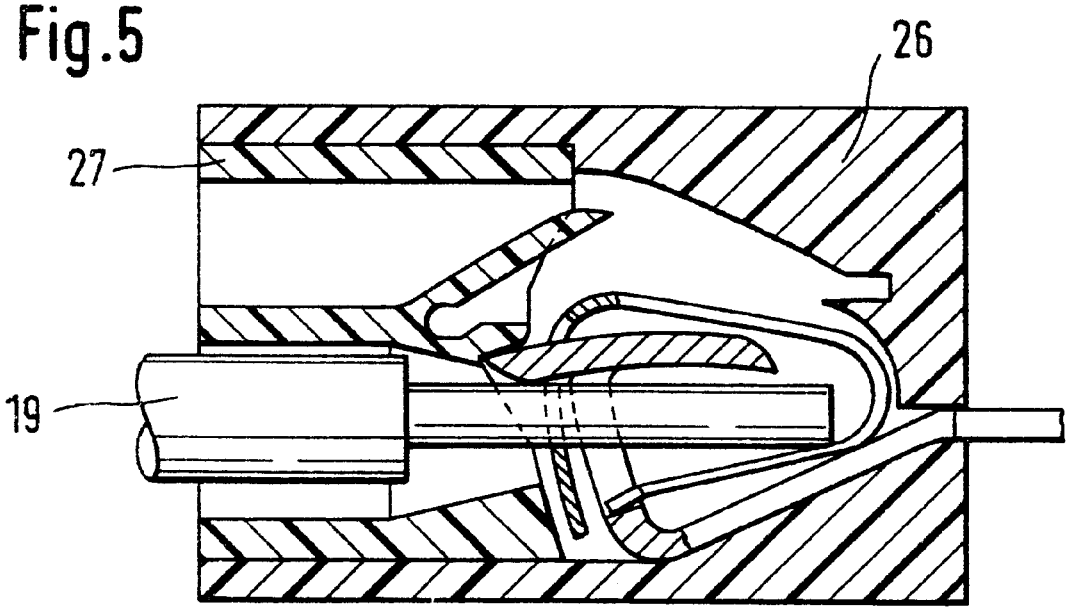

The platform 17 in the upper level of the current bar forms the stopper element for the clamping leg 12 of the clamping spring against unwanted overloading of the clamping leg or the backward spring bow (10) when the clamping leg 12 is pressed down for the opening of the clamping unit for the introduction of an electrical conductor. This is shown in FIGS. 4 and 5 (see the clamped electrical conductor 19 in FIG. 5).

The platform 17, which is arranged in the upper level, comprises an extension 20 in the direction of the inner space of the clamping spring. Said extension leads the electrical conductor 19 when being introduced into the inner space of the clamping spring. Furthermore the electrical conductor is guided by the contact leg 11 of the clamping spring, which lies on the current bar in the lower level (see FIG. 5).

Figure 6:
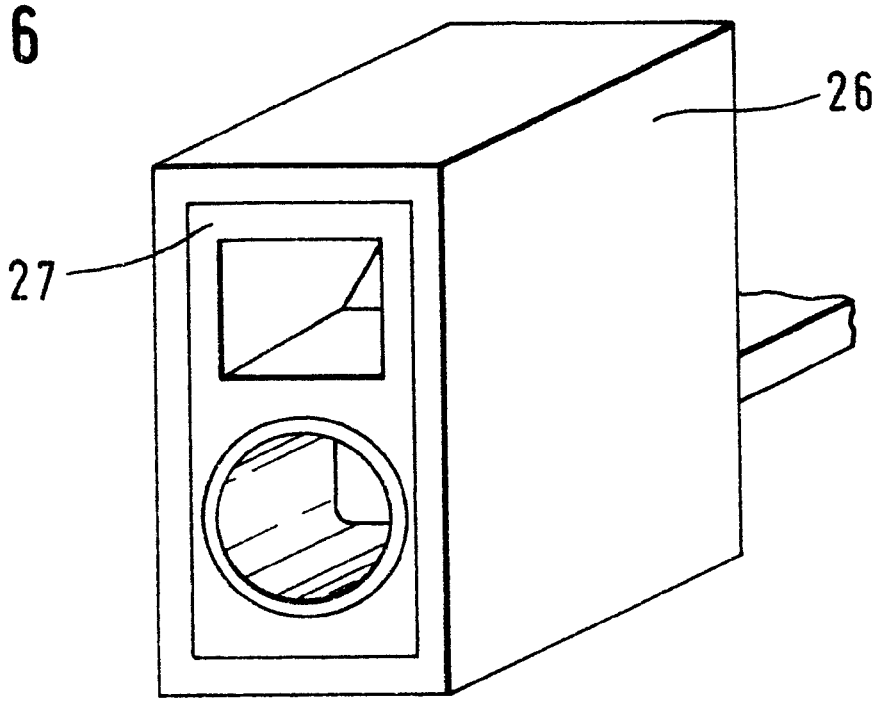
Figure 7:
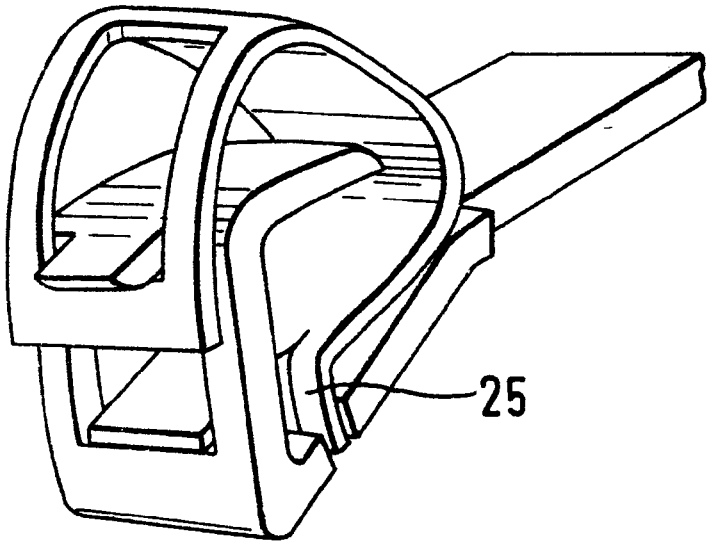
FIG. 7 shows a third embodiment of the invention.

The embodiment of the clamping connections shown in FIGS. 3 to 6 and the embodiment shown in FIG. 7 differ from the embodiment shown in FIGS. 1 and 2 only by the choice of different fixings of the contact leg of the clamping spring.

According to FIGS. 1 and 2, the front edge of the contact leg 11 runs through the wall opening 18 of the spacer frame 15 and is somewhat bent downwards in such a way that it inter-locks in the transverse bead 21, which is provided in the platform 16. With regard to this please also see claim 3.

In the embodiment of FIGS. 3 to 6, the front edge of the contact leg extends just into the wall opening 22 and is somewhat bent downwards in such a way that the front edge is hooked into the lower soffit surface of the wall opening. Alternatively, or additionally, the soffit surface of the wall opening can also be produced to be inclined outside (i.e. to the left side in FIGS. 4 and 5), so that the bent downwards front edge of the contact leg is coupled with the inclined soffit surface. With regard to this please also see FIG. 3. In combination with the shoulders 23 of the contact leg abutting against the inner side of the spacer frame 24, this is a safe fixing of the contact leg in the lower level of the current bar.

According to FIG. 7 the contact leg of the clamping spring is fixed with tongues 25, which lock into the side-open nuts of the current bar.

FIG. 6, along with FIGS. 4 and 5 shows an insulating housing as an example for a spring loaded clamping connection of the invention which has one pole and one clamping unit only. Of course, the new clamping connection can be built also in form of a multi-pole connection and/or in form of a clamping connection having more than one clamping unit for electrical conductors.

The insulating housing 26 shown in FIG. 6 (cross sections thereof are shown in FIG. 4 and FIG. 5) comprises a receiving chamber for the new clamping connection which is closed by a lid 27. This lid is a holder to fix the clamping connection inserted into the receiving chamber of the insulating housing (see FIG. 4 and FIG. 5). Said lid-holder 27 has an introduction channel 28 for the introduction of an electrical conductor 19 and an operating slot 29 in which a screwdriver (not shown) can be introduced to open the clamping unit. The screwdriver blade is guided by the guiding flap 30 so that the screwdriver blade enters on the back of the clamping leg 12 and presses the clamping leg down to open the clamping unit.

It will be understood that the invention is not limited to the embodiments described, but encompasses all equivalents falling within the scope of the invention as claimed.

What is claimed is:

1. A spring loaded clamping connection for electrical conductors, comprising:

a clamping spring which is made from a spring steel sheet and which is mounted on a free end of a current bar, punched out of a strip of flat material having good electrical conductivity, said clamping spring having a backward spring bow from which extends a contact leg which lies on the current bar, and a clamping leg which is bent in a shape of a loop with a free end of the clamping leg running crosswise to the free end of the current bar, the free end of the clamping leg having a window opening through which the free end of the current bar extends such that a clamping unit is formed between a lower edge of the window opening and an underside of the current bar, and further including an electrical conductor which is inserted between the lower edge of the window opening and the current bar and which is clamped to the underside of the current bar, the end part of the current bar on which the clamping spring is mounted, having two levels at different heights, namely an upper level adjacent the free end of the current bar that cooperates with the opening of the clamping leg to form said clamping unit, and a lower level adjacent, the contact leg of the clamping spring that lies on the current bar; and a spacer frame disposed between the upper level and lower level, the spacer frame being formed out of a part of the current bar to carry the upper level above the lower level, whereby said spacer frame is overlapped by the clamping leg of the clamping spring and is arranged with its fee-end into an inner space of the clamping spring, wherein in the upper level there is a platform which is bent from the spacer frame in the direction of the window opening of the clamping leg;

whereby an end of said platform extends from inside said clamping spring through said window opening to outside said clamping spring in such a way that the clamping unit for an electrical conductor is formed between the underside of said platform and the lower edge of said window opening;

and moreover, further including a wall opening in the spacer frame between the upper level and the lower level which allows an end of an electrical conductor clamped in the clamping unit to extend into the inner space of the clamping spring.

2. The spring loaded clamping connection as claimed in claim 1, wherein the platform in the upper level is provided with an extension in a direction of the inner space of the clamping spring, said extension leads an electrical conductor when being introduced into the inner space of the clamping spring.

3. The spring loaded clamping connection as claimed in claim 1, wherein the front-edge of the contact leg of the clamping spring runs through the wall opening and is bent downwards in such a way that it inter-locks in a transverse bead provided in a platform which is part of the current bar and which is bent outside from said spacer frame.

4. The spring loaded clamping connection as claimed in claim 1, wherein the wall opening in the spacer frame is cut out to extend downwards to the lower level;

the front-edge of the contact leg of the clamping spring extends just into the wall opening and lies on the lower soffit surface of the wall opening;

and from at least one side of the contact leg of the clamping spring, a tongue is punched out and is bent downwards, which locks into a side-open nut of the current bar.

5. The spring loaded clamping connection as claimed in claim 1, wherein the wall opening in the spacer frame is cut out to extend downwards to the lower level;

and the front-edge of the contact leg of the clamping spring extends just into the wall opening, and is bent downwards in such a way that said front-edge of the contact leg is coupled with a lower soffit surface of the wall opening.

6. The spring loaded clamping connection as claimed in claim 1, wherein the wall opening in the spacer frame is cut out to extend downwards to the lower level;

and the front-edge of the contact leg of the clamping spring extends just into the wall opening, and is bent downwards in such a way that said front-edge of the contact leg is hooked into a lower soffit surface of said wall opening.

7. The spring loaded clamping connection as claimed in claim 4, wherein said front edge of the contact leg is further coupled with a lower soffit surface of the wall opening.

8. The spring loaded clamping connection as claimed in claim 1, wherein at least from one side of the contact leg of the clamping spring a tongue is punched out and is bent downwards to inter-lock with a side-open nut of the current bar.

* * * * *